United States Patent [19]

Sumner

[11] 4,302,914

[45] Dec. 1, 1981

[54] MULTI-EDGED SHELL STRUCTURE

[76] Inventor: John S. Sumner, 728 N. Sawtelle, Tucson, Ariz. 85716

[21] Appl. No.: 119,484

[22] Filed: Feb. 7, 1980

[51] Int. Cl.[3] ..... E04B 1/32

[52] U.S. Cl. ..... 52/80; 52/518; 52/741

[58] Field of Search ..... 52/80, 81, 82, 518, 52/741

[56] References Cited

U.S. PATENT DOCUMENTS

| | | | |
|---|---|---|---|
| 2,736,072 | 7/1951 | Woods . | |
| 2,874,651 | 2/1959 | Peterson | 52/82 X |
| 2,905,113 | 9/1959 | Fuller . | |
| 2,978,074 | 4/1961 | Schmidt . | |
| 3,197,927 | 8/1965 | Fuller | 52/81 |
| 3,877,186 | 4/1975 | Cartier | 52/82 |
| 3,990,208 | 11/1976 | Henderson | 52/82 X |
| 4,092,810 | 6/1978 | Sumner | 52/81 |

*Primary Examiner*—James A. Leppink
*Assistant Examiner*—Carl D. Friedman
*Attorney, Agent, or Firm*—Warren F. B. Lindsley

[57] ABSTRACT

A method for constructing a multi-edged shell surface using elongated strips of wood or other materials. The positioning of the strips and the shaping of the ends of the strips are defined by a procedure employing circumscribed cones.

12 Claims, 14 Drawing Figures

FIG. 3
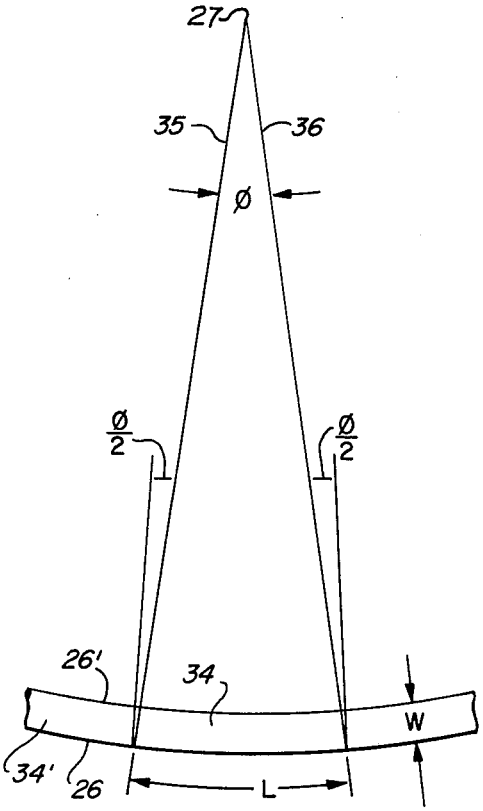
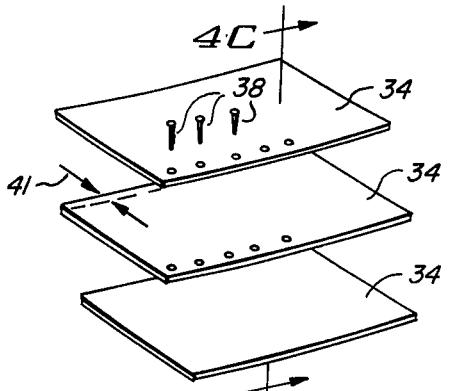
FIG. 4A
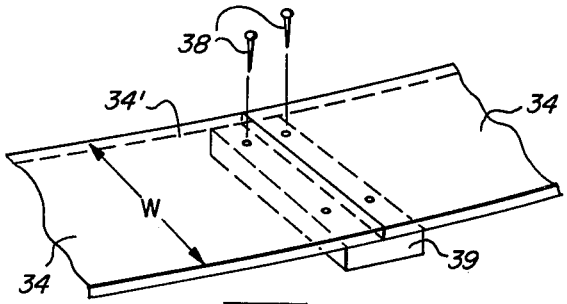
FIG. 4B
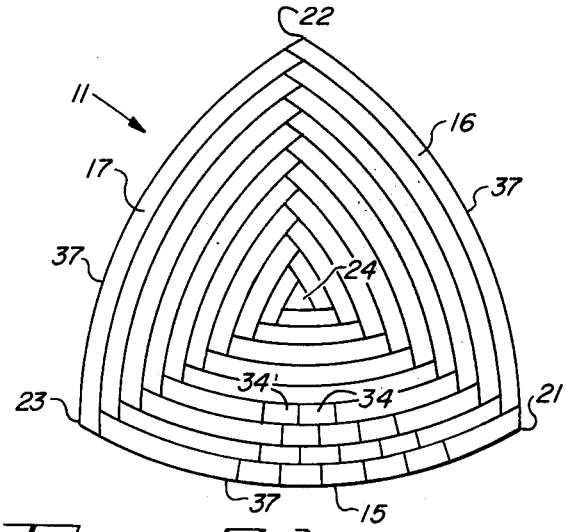
FIG. 5A
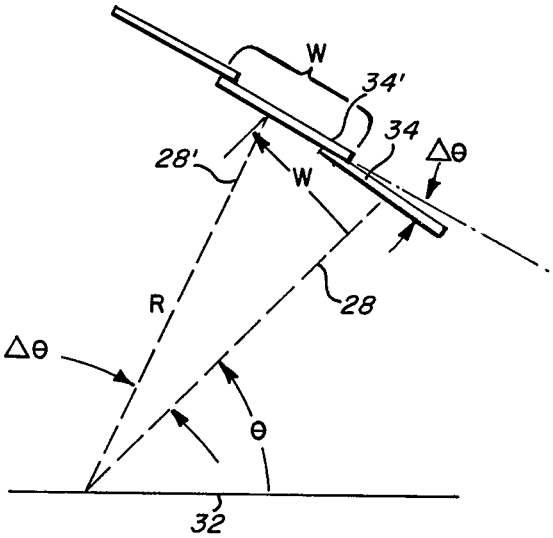
FIG. 4C
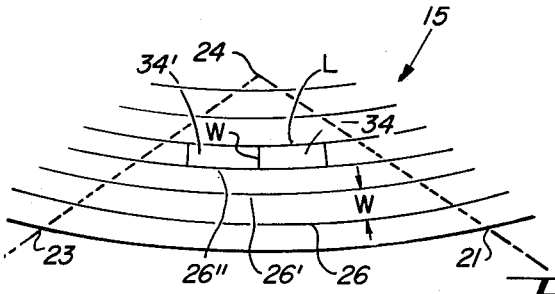
FIG. 2D

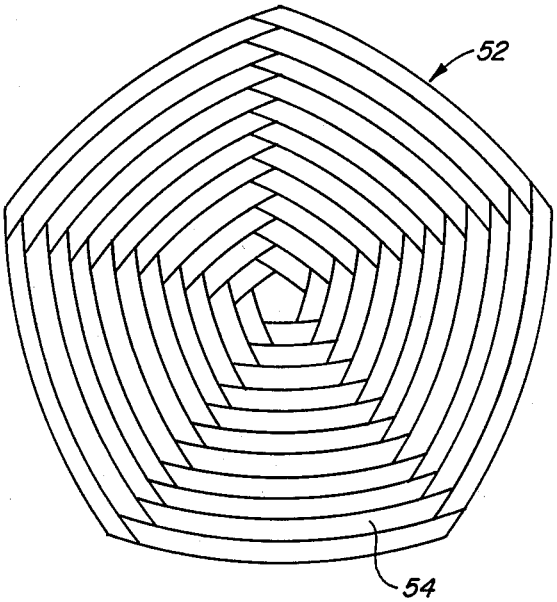
FIG. 5C
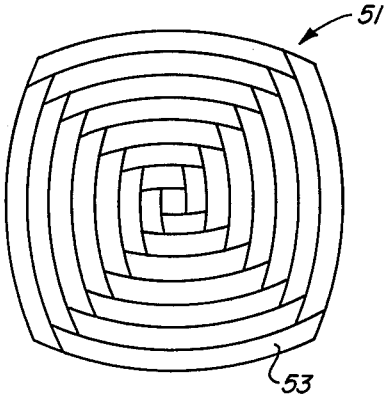
FIG. 5B
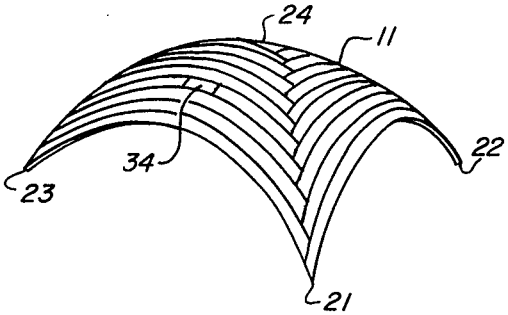
FIG. 7
FIG. 6
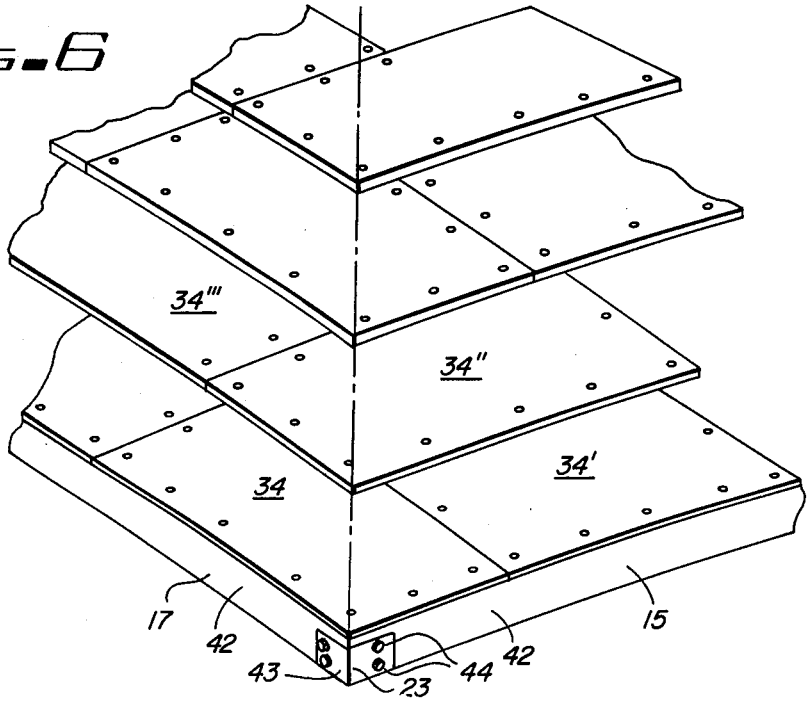

MULTI-EDGED SHELL STRUCTURE

BACKGROUND OF THE INVENTION

A shell is defined as a curved structural body with a thickness much less than the radius of curvature of the surface. A shell is essentially characterized by its reference surface, its thickness, and its edges. The reference surface defines the overall shape of the shell and it is a principal factor in the structural behavior of the body.

The usually right angled edges of shells are necessarily thicker or at least stronger than the shell surface itself. In this invention, the shell edges are arcs of great circles lying on a spheroidal surface of revolution. Parabolic, spherical or ellipsoidal surfaces can thus be designed using this inventive concept.

The theory of thin shells has been well developed in the classical mathematical and physical mechanics literature. To a first approximation, the important membrane action of shells implies that their resistance to external loads is carried by internal forces induced within the shell surface, analogous to the skin forces of a balloon in resisting internal pressures.

Although shells are well known in nature and in certain artificial structures, such as airplanes, boats and automobiles, they have not gained wide acceptance because of the difficulties in fabricating and erecting these structures. Most large shells have complicated joint connections which are not easily assembled in the field and the specialized plate and beam members are not easily formed and installed. Spherical surfaces have been inherently more difficult to lay out than rectangular shapes compatible with normally available building materials. Large reflectors have usually not been feasible because of weight, structural complexity, aiming problems and wind loads.

It is the purpose of these specifications to describe a novel but simple method of constructing relatively large shells which can be utilized as solar reflectors or as cost efficient buildings. Large solar reflectors hold considerable promise for concentrating solar energy on a small area, perhaps using a movable focal point which for a sphere is located at half the radius of curvature from the reflecting surface. When used either as a reflector or as a domical building, the shell edges also act as edge arches and thus need only be supported at the corners where the edges join one another.

DESCRIPTION OF THE PRIOR ART

Considerable attention has been given to innovations that would hopefully lead to the surmounting of past difficulties in constructing shells.

G. B. Woods (U.S. Pat. No. 2,736,072) proposed the division of the hemisphere into triangular quadrants and each quadrant into three four-sided spherical figures, the latter division being accomplished by drawing lines from the midpoint of the quadrant to the midpoint of each of its three sides. The resulting dividing lines lie along great circle arcs and define the supporting framework. Woods then goes on to describe a method for covering the four-sided spherical area using originally flat sheathing material, the method relying upon the subdivision of the area so as to obtain a flat diamond shaped central area surrounded by four curved isosceles triangles over which a flat sheathing material could be laid and fitted to follow the curvature of the supporting beams.

R. B. Fuller (U.S. Pat. No. 2,905,113) describes a self-strutted geodesic structure in which overlapping rectangular panels are joined along the outlines of a grid of geodesic triangles. The triangles are isosceles, again with the apparent purpose of facilitating the forming of the corners of the panels to the spherical shell surface. Surface coverage is incomplete and the structure has not met with wide industry or public acceptance.

In a later patent (U.S. Pat. No. 3,197,927), Fuller defines sets of pre-formed and pre-shaped elements that may be assembled on the site into geodesic structures.

C. J. Schmidt (U.S. Pat. No. 2,978,074) subdivides a spherical surface by a framework of curved triangles in order to facilitate the covering of the structure with flat sheathing materials. In this case, a spherical pentagon is subdivided by lines from the center to the five corners. These lines define the framework of isosceles triangles which can then be fitted by inserting flat triangular panels. The covering material lies flat over the center of a triangle and follows the curvature of the supporting structure over the edges.

J. S. Sumner, inventor of the present disclosure, discloses in U.S. Pat. No. 4,092,810 a shell surface construction that eliminates the supporting structure entirely and subdivides the spherical surface into scalene triangles. The total frameless structure utilizes a single triangular element in left-hand and right-hand configurations. Two such elements may be readily cut from a single sheet of plywood of standard dimensions with a minimum of waste. The elements or panels overlap at the edges where they are secured together to form great circle arcs, the overlapping edges composing in themselves an integral reinforcing supportive structure.

FIELD OF THE INVENTION

The present invention addresses the problem of constructing shell surfaces using substantially rectangular strips of material in dimensions and proportions that are compatible with those of commercially available building materials. The intent of the invention is to achieve a maximum utilization of the standard materials with a minimum of waste. A further goal is to provide a method that does not restrict its use to any limited range of structure sizes.

From spherical geometry it is known that the great circle of a spheroid has a perpendicular axis, defined as the center diameter normal to the plane of the great circle. In turn, this axis defines families of small circles and planes which are parallel to the great circle. If closely spaced, the parallel planes intersect conical strips on the surface of the reference spheriod. The axis of the cone coincides with the axis of a corresponding great circle edge.

Each curved, great circle edge of a multi-edged shell defines the outer boundary of a radial sector on the shell surface. The radial sectors all have a common interior corner at the shell center. These spherical triangular sectors can be surfaced with concordant strips of covering material, starting along the outer great circle edge and progressing inwardly.

The method provided may permit the construction of the shell as a self-supporting or free-standing form or it may be utilized as a covering over a skeletal spherical surface.

SUMMARY OF THE INVENTION

In accordance with the invention claimed, an improved shell surface construction or covering is provided that utilizes as its basic building block an elongated, substantially rectangular strip. The strips are of constant width and are modified at their ends to trapezoidal form permitting their assembly using joints at the ends and overlapping side joints along the long edges of the strips.

It is, therefore, one object of the present invention to provide an improved shell structure.

Another object of the invention is to provide a means for initially subdividing the spherical surface into spherical triangular sectors that lend themselves to the application of the construction or covering method of the invention.

A further object of the invention is to provide an improved method for further subdividing a spherical triangular sector beyond that realized in geodesic dome construction.

A still further object of the invention is to provide a means for enlarging the overall size of the structure so that large multi-sided shells can be constructed.

A still further object of the invention is to provide a means of construction that can be applied to originally flat strips of material having essentially parallel edges.

A still further object of this invention is to provide a constructional method not requiring a permanent supporting framework or using special erection or assembly tools.

A still further object of this invention is to provide a shell design that is cost-effective in terms of materials and constructional labor.

A still further object of this invention is to permit the realization of heating and cooling efficiencies which may result from domical shell structures and their capabilities for enclosing a maximum volume with a given exposed surface area.

Another object of the invention is to use the fewest number of simple, standard shapes of constructional materials. Yet another object of this invention is to provide a constructional means for taking full advantage of elastic theory as set forth for thin-wall shell structures.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWINGS

The present invention may be more readily understood by reference to the accompanying drawing in which:

FIG. 2D is an enlarged view of a sector of the three-edged shell of FIGS. 1, 2A, 2B and 2C;

FIG. 3 illustrates a conical strip forming a constructional element of a domical shell structure formed by the circumscribed cones of FIGS. 2A–2C;

FIGS. 4A and 4B are detailed perspective views of overlapping and abutting elongated strips employed as the constructional elements or building blocks embodying the invention;

FIG. 4C is a cross-sectional view of the elements of FIGS. 4A and 4B as seen along line 4C—4C of FIG. 4A;

FIGS. 5A, 5B and 5C are plan views of three, four and five-sided domical surfaces constructed in accordance with the principles of the invention;

FIG. 6 is a detailed perspective view of a corner of a multi-edged shell structure in accordance with the construction defined by the invention; and FIG. 7 is a perspective view of a three-edged shell constructed in accordance with the principles and procedures defined by the disclosed invention.

DESCRIPTION OF THE PREFERRED EMBODIMENT

Figure 1:
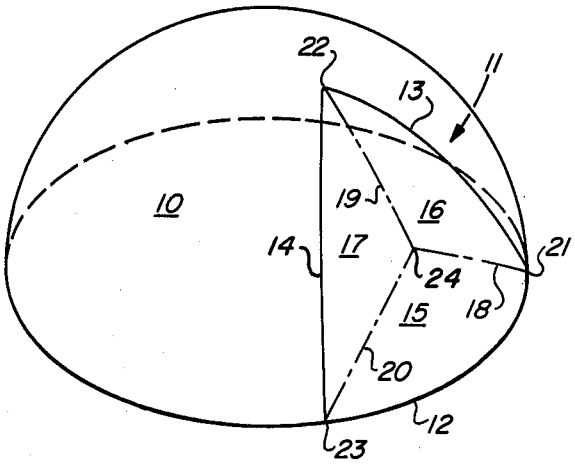
FIG. 1 illustrates a hemispheroid showing an inscribed uptilted three-edged shell which is further subdivided into three sectors; this three-edged surface constituting the simplest form of the multi-edged shell structure of this invention.

Referring more particularly to the drawing by characters of reference, FIG. 1 illustrates a hemispheroid 10 within which is inscribed a three-edged shell 11. The edges 12, 13 and 14 of shell 11 lie along great circle arcs of sphere 10. Shell 11 is subdivided into sectors 15, 16 and 17 by the bisectors 18, 19 and 20, respectively, of the corners 21, 22 and 23 of shell 11. The intersection of bisectors 18, 19 and 20 defines an apex 24 of shell 11.

Figure 2B:
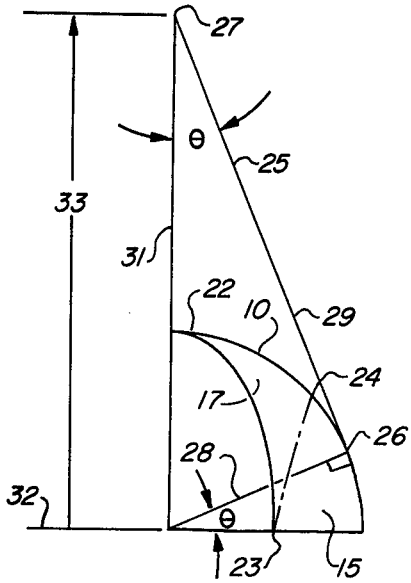
FIG. 2B is a partial cross-sectional view of the construction shown in FIG. 2A taken along a plane that passes through the common axis of the sphere and cone of FIG. 2A vertically bisecting the three-edged inscribed shell.
Figure 2A:
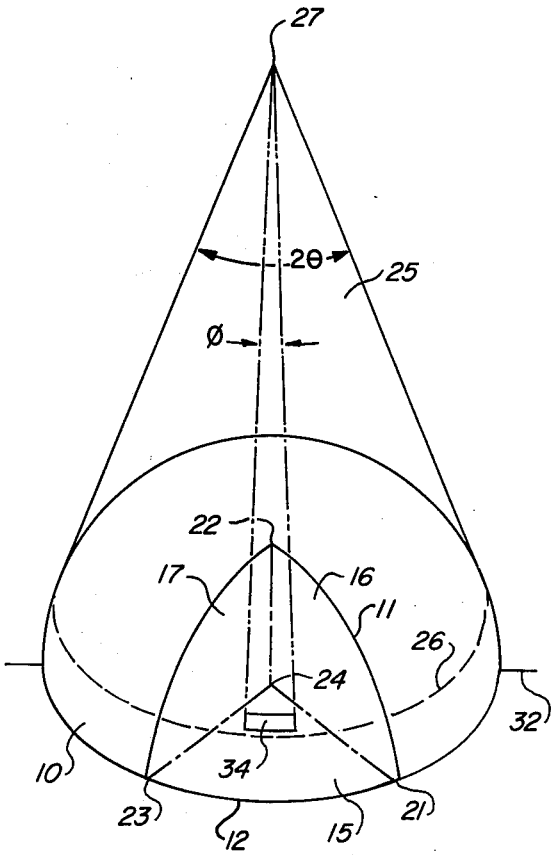
FIG. 2A illustrates the circumscription of a conical surface over the spherical surface and the inscribed three-edged shell of FIG. 1 in conjunction with a means for the constructional subdivision thereof.
Figure 2C:
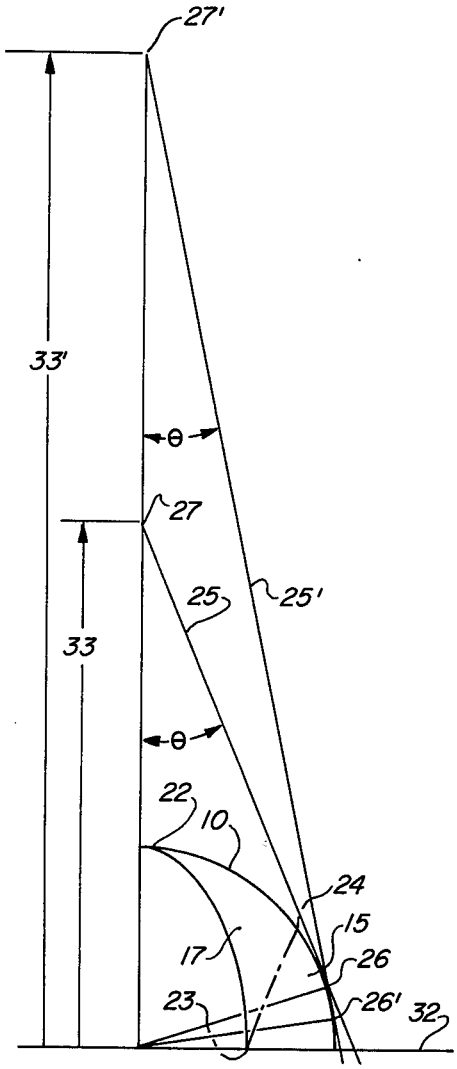
FIG. 2C is an elaboration of FIG. 2B showing in addition thereto a second inscribed conical cross-section of a different length.

With reference to FIGS. 2A, 2B and 2C, a cone or conical surface 25 is circumscribed over spherical sector 15 with the plane of the circle of tangency 26 passing horizontally through sector 15. Cone 25 has an apex 27 and a generating apex angle $\theta$. A radius 28 of hemisphere 10 meets the circle of tangency 26 as shown in FIG. 2B and forms a right angle with the edge 29 of cone 25.

As shown in FIG. 2B, it is important to note that edge 12 and cone 25 have a common axis 31 that is perpendicularly arranged to a reference plane 32. Cone 25 has an overall height 33 with respect to plane 32 and the length of edge 29 of cone 25, i.e., the slant height of cone 25, is equal to the distance between apex 27 and circle 26. Angle $\phi$ lies on the surface of cone 25 and angle $\phi$ is much less than apex angle $\theta$.

It will be recognized that as the height 33 of cone 25 is increased while maintaining cone 25 tangent to sphere 10, the circle of tangency 26 moves downwardly toward plane 32. This effect is illustrated in FIG. 2C where two cones 25 and 25' having heights 33 and 33', respectively, are shown to intersect hemisphere 10 at circles of tangency 26 and 26', respectively. In an extension of this procedure, a succession of incremental heights 33, 33', 33'', etc. will produce a corresponding set of parallel circles 26, 26', 26'', etc. passing across the face of sector 15, as shown in FIG. 2D. If the increments of the heights of cone 10 are appropriately chosen, the parallel circles 26, 26', 26'', etc. will be equally spaced with a separation W as shown. The lines 26, 26', 26'', etc. define the edges of the elongated conical strips described in the present disclosure as the construction elements for the domical surface. One such element 32 is shown in FIG. 2D which has a width W and a length L.

Referring now to FIG. 3 which again shows element 34 positioned between parallel line 26 and 26', the length L is seen to be a maximum dimension for the element which is actually trapezoidal rather than rectangular in configuration. As shown in the enlarged view of FIG. 3, the ends of element 34 are defined by rays 35 and 36 which emanate from the apex 27 of the circumscribed hemisphere employed in the formation of line 26. These rays 35 and 36 subtend the maximum length L of element 34 and define an angle of taper $\phi/2$ to which the ends of the element 34 are to be cut. The taper angle $\phi/2$ is also defined by the end tilt angle of the trapezoidal projection of element 34 onto a circumscribed cylindrical surface (not shown) conforming with the curvature of element 34. The tapered end cuts are made to provide proper mating at the butt-joints between adjacent elements 34 and 34' that are to be aligned end-to-end between the two adjacent lines 26 and 26'. It is readily apparent from FIG. 3 that the taper angle $\phi/2$ is equal to one-half the angle $\phi$ that is formed between the rays 35 and 36. This relationship will be employed later in a calculation of taper angles for a specific embodiment of the invention in which element 34 is cut from a two-by-eight foot sheet of plywood or other common construction material. Because the elements 34 have their taper angles $\phi/2$ defined by rays from the apex 27 of cone 25 which has different lengths for different vertical positions over the surface of sector 15, there will be correspondingly different taper angles.

After a set of elements 34 has been thusly defined and cut accordingly to cover surface 15, they are applied to sector 15 as shown in FIG. 5A. An identical set is employed to cover sector 16 and another to cover sector 17. The elements are applied in a manner similar to the application of conventional shingles to a flat roof, beginning with the first course at the lower edge 37 of each of the sectors 15, 16 and 17 and working upwardly, one course at a time, toward the apex 24.

Details of the joining and mating together of the individual elements 34 are shown in FIGS. 4A, 4B, 4C and 6. FIG. 4B shows a butt joint formed between the ends of adjacent elements 34 and 34'. Screws or nails are employed to fasten the abutting ends of the elements to a block 39 which backs up the joint from underneath. As shown in FIG. 4A, successive courses of elements 34 overlap by a small amount 41 to permit the securing together at the overlapped edges by means of nails or screws 38. Glue may be employed as an alternate means for joining or in conjunction with nails or screws for further strengthening and sealing the joint.

At the corners of shell 11 where sectors 15, 16 and 17 meet, the adjoining ends of elements 34 are individually cut to provide a proper fit between corresponding courses of adjoining sectors. FIG. 6 shows a lower corner construction corresponding to corner 23 at the junction of sectors 15 and 17. The lower course is supported by edge arch members 42 which are tied together by means of a metal bracket 43 and screws or bolts 44. The corner of end element 34 of sector 17 is seen to extend into sector 15 where its edge mates with a specially cut end of an element 34' in the corresponding lower course of sector 15. In the second course, end element 34'' of sector 15 extends into sector 17 to mate with a specially cut end element 34''' of sector 17. Extensions are alternated in this manner through successive courses.

The curvature of the surface of hemisphere 10 results in a tilting of successive courses of elements 34 with respect to adjacent courses. A means for calculating the relative angular displacement between the surfaces of elements 34 in adjacent courses is derived from the illustration of FIG. 4C which shows an edge view of two adjacent courses and their corresponding elements 34 and 34'. A radius 28 of the hemisphere perpendicularly intersects the center of element 34 and forms an angle $\theta$ with surface 32. In the next higher course, the radius 28' perpendicularly intersects the center of the next higher element 34'. The angular displacement between the two radii 28 and 28' is referenced as $\Delta\theta$ and is given (approximately) by the equation $\Delta\theta = \text{arc tan } W/R$ where W is the width of element 34 and R is the radius of hemisphere 10. More precisely, $\Delta\theta = \text{arc tan } Y/R$ where Y is equal to W diminished by the amount of overlap 41 between successive courses of elements 34.

A method for defining and assembling a three-edged shell 11 has thus been provided in the foregoing description. The same method may be applied to provide the four-sided and five-sided shells 51 and 52 of FIGS. 5B and 5C, respectively. The circumscribed cone constructions are employed in these cases to a quarter-sector 53 of shell 51 and to a one-fifth sector 54 of shell 52.

The validity of the design just described is demonstrated by the calculations summarized in Table I. The calculations for Table I are based on a spherical radius R of 38.2 ft. and on a three-edged inscribed shell surface with an outer edge dimension (arc length) of 60 feet. The elements 34 are assumed to have a width of two feet and an overall length of eight feet. Overlap between successive courses is two inches.

TABLE I

| Course # | Cone Apex Angle $\theta$ | Cone Slant Height (ft) | Trapezoidal 0/2 Degrees | Taper Inches per 2' Width |
|---|---|---|---|---|
| 1 | 1.375° | 1591.36' | 0.14° | .06 |
| 2 | 4.124° | 529.64' | 0.43° | .18 |
| 3 | 6.875° | 316.80' | 0.72° | .30 |
| 4 | 9.625° | 225.24' | 1.02° | .43 |
| 5 | 12.375° | 174.09' | 1.32° | .55 |
| 6 | 15.125° | 141.32' | 1.62° | .68 |
| 7 | 17.875° | 118.44' | 1.96° | .82 |
| 8 | 20.625° | 101.49' | 2.26° | .95 |
| 9 | 23.375° | 88.37' | 2.59° | 1.09 |
| 10 | 26.125° | 77.88' | 2.94° | 1.23 |
| 11 | 28.875° | 69.27' | 3.31° | 1.39 |
| 12 | 31.625° | 62.03' | 3.70° | 1.55 |
| 13 | 34.375° | 55.84' | 4.11° | 1.72 |
| Shell Apex | 35.264° | 54.02' | 4.25° | 1.78 |

For the first course the cone apex angle $\theta$ is defined by:

$$\theta = \text{arc tan } \frac{.5(W - 2'')}{R} \text{ (see FIG. 2B)}$$

$$= \text{arc tan } \frac{.5(22)}{(38.2)\,(12)}$$

$$= 1.375 \text{ degrees}$$

Note that for the first course, the radius R' defining $\theta$ is drawn to the center of the lowest element 34 so that $\theta$ subtends one-half the width W of the element 34 (diminished by the overlap). Hence, tan $\theta$ is equal to $0.5(24'' - 2'')/38.2'(12)$. With each succeeding course, $\theta$ is increased by an amount corresponding to $\Delta\theta$ which was earlier shown to be given by:

$$\Delta\theta = \text{arc tan}\left(\frac{W - \text{overlap}}{R}\right)$$

$$= \text{arc tan}\left(\frac{22''}{(38.2')\,(12)}\right)$$

$$= 2.75 \text{ degrees}$$

From FIG. 2B, it is seen that:

$$\tan\theta = \frac{\text{Radius 28 of sphere 10}}{\text{cone slant height 29}}$$

$$= \frac{38.2}{\text{cone slant height}}, \text{ or}$$

$$\text{cone slant height} = \frac{38.2}{\tan\theta}.$$

The cone slant height (column 3) is thus calculated for each course using the values shown in column 2 for $\theta$.

The trapezoidal taper or projection shown in column 4 is calculated from the formula derived earlier on the basis of FIG. 3 which is given as follows:

$$\text{taper (degrees)} = \phi/2$$

$$= \text{arc tan}\left(\frac{.5L}{\text{cone slant height}}\right)$$

$$= \text{arc tan}\ \frac{4'}{\text{slant height (ft)}}$$

Application of the above formula using the slant height values from column 3 yields the corresponding degrees of taper shown in column 4.

Finally, the inches of taper shown in column 5 are calculated from the degrees of taper as follows:

$$\tan\phi/2 = \frac{\text{inches of taper}}{24''}, \text{ or}$$

Application of the above formula using values of $\phi/2$ as shown in column 4 yields the corresponding taper dimensions in inches shown in column 5.

An examination of the tabulated values shown in Table I indicates the following:

First, the relative tilt or angular displacement between successive courses is only 2.75 degrees. An essentially smooth and continuous surface is thus provided across the overlapped courses.

Second, the amount of taper is quite small, beginning at 0.14 degrees at the edge to 4.25 degrees at the apex (0.06 and 1.78 inches, respectively, across the two foot width of the eight foot element 34). This is indicative first of extremely low material waste. At the same time, it suggests that the use of the straight-edged elements 34 to approximate the conical surfaces will produce only minor deviations from the circles of tangency 26.

The success of this herein disclosed sector-and-strip method of shell covering is due to the fact, as shown in Table I, that the shell apex 24 is only 35.3 degrees away from the sector edge and the derived conical curvature of the strips is minimal in comparison to a cylindrical curvature.

Shell surfacing elements must have a certain amount of stiffness and therefore even with an underlying forming surface, these surfacing elements may not readily assume an exact conical shape, but rather the elements may prefer a simple cylindrical curvature. From spherical trigonometry, end taper angles can easily be calculated for great circle cylindrically curved conformal elements. These angles and also the overlap interval between successive course elements are found to be substantially the same as, but slightly less than, those calculated in Table I for the conical shape, the differences always being less than a few percent.

An effective and efficient construction or covering method is thus defined for shell surfaces in accordance with the stated objects of the invention and although but a few embodiments of the invention have been illustrated and described, it will be apparent to those skilled in the art that various changes and modifications may be made therein without departing from the spirit of the invention or from the scope of the appended claims.

What is claimed is:

1. A method of covering a multi-edged spherical surface, the edges of which comprise outwardly leaning great circle arcs, the method comprising the steps of:

dividing the surface into sectors one associated with each edge of the surface, forming conical strips of a building material shaped to simulate, when assembled, the outer periphery of the spherical surface, forming the ends of each strip in a given course utilizing a trapezoidal projection so as to adjoin with an adjacent strip in said course, assembling the conical strips of each sector in courses commencing with the first course positioned along the edge of the sector formed by the great circle arc, and overlapping said first course formed by said conical strip with successively positioned strips of a second course in each sector and continuing said overlapping operation with further courses until the apex of the shell has been reached.

2. The method set forth in claim 1 wherein:

said strips are segmented into a plurality of parts with the ends of each part being formed by trapezoidal projections.

3. The method set forth in claim 1 wherein:

the end of the strip in any given course of one sector abuts the side of the strip in the corresponding course of an adjacent sector.

4. A method of forming the surface of a multi-edge spherical shell the edges of which comprise outwardly leaning great circle arcs, the method comprising the steps of:

dividing the surface into a number of sectors one associated with each edge of the surface, forming different sized cones on an axis of the shell which axis is substantially perpendicular to the plane of the great circle formed by the outer edge of the sector of the shell, the conical surface of each of the cones being tangent with the surface of the sector of the shell at different line contacts around the sector, said axis defining along its length circular planes through the sector at said line contacts which are parallel to the plane of said great circle, the circular planes defining between their peripheries conical strips, segmenting said strips, and assembling said strips along each sector of the shell in courses starting with the outer edge of a sector of the shell and progressing to the apex of the sector at substantially the same place on the shell and in the sequence during which they were defined.

5. The method set forth in claim 4 in further combination with the step of:

forming the ends of each segment utilizing a trapezoidal projection so as to cause each segment in each strip to closely adjoin with an adjacent segment.

6. The method set forth in claim 4 in further combination with the step of:

forming an end of each segment in each strip with a trapezoidal projection so as to cause each segment to closely abut with an adjacent segment of the strip.

7. The method set forth in claim 4 wherein:

the forming of said different size cones in progressively performed starting with a cone of one size and continuing through cones of progressively smaller sizes to define strips which when layed in courses cover the whole sector.

8. The method set forth in claim 5 wherein:

the trapezoidal projection results in a taper of each end which is equal to the ratio of one-half the length of the strip to the slant height of the cone.

9. A spherically contoured structural shell having three or more edges formed of outwardly leaning great circle arcs comprising:

a plurality of self supporting, overlapping courses of conically shaped trapezoidal strips, and a plurality of edge supports arranged along said edges of said shell wherein each of said edge supports lies along a great circle arc of said spherically contoured shell, said edges forming angles at their junctions, the bisectors of which substantially define three or more sectors of said shell, the number of said sectors being equal to the number of said sides, said bisectors defining at their common intersection the apex of said shell.

10. The spherically contoured structural shell set forth in claim 9 wherein:

the first of said courses of each sector is aligned with and lies directly upon one of said edge supports, each successive course lying parallel with and minimally overlapping the preceding course, the succession of such overlapping courses continuing until said apex is reached by the last of said courses.

11. The spherically contoured structural shell set forth in claim 9 wherein:

each of said courses comprises a set of identical trapezoidal strips linearly aligned and adjoined along the length of said course.

12. The spherically contoured structural shell set forth in claim 10 wherein:

the conical surfaces of the successive courses are defined about a common axis and the distance of each course from the apex of its associated said conical surface decreases with each successive course in progressing from said first to said last course.

* * * * *

UNITED STATES PATENT OFFICE

CERTIFICATE OF CORRECTION

Patent No. 4,302,914 Dated December 1, 1981

Inventor(s) John S. Sumner

It is certified that error appears in the above-identified patent and that said Letters Patent are hereby corrected as shown below:

Claim 7, line 2, after "cones" delete "in" and substitute ---is---.

Signed and Sealed this

*Sixteenth* Day of *February 1982*

[SEAL]

*Attest:*

GERALD J. MOSSINGHOFF

*Attesting Officer*

*Commissioner of Patents and Trademarks*

UNITED STATES PATENT OFFICE

CERTIFICATE OF CORRECTION

Patent No. 4,302,914 Dated 12/1/81

Inventor(s) John S. Sumner

It is certified that error appears in the above-identified patent and that said Letters Patent are hereby corrected as shown below:

Column 6, line 38, in "Table I, 4th column", under "Trapezoidal", add a slash line through the 0 in "0/2 Degrees" to read: ---Ø/2 Degrees---.

Column 7, line 46, after "tan Ø/2= inches of taper, or" insert the following:
24"

---inches of taper=(tan Ø/2)(24).---

Signed and Sealed this

Twenty-ninth Day of June 1982

[SEAL]

Attest:

GERALD J. MOSSINGHOFF

Attesting Officer

Commissioner of Patents and Trademarks